US005779892A

United States Patent [19]

Miltenyi et al.

[11] Patent Number: 5,779,892

[45] Date of Patent: Jul. 14, 1998

[54] MAGNETIC SEPARATOR WITH MAGNETIC COMPENSATED RELEASE MECHANISM FOR SEPARATING BIOLOGICAL MATERIAL

[75] Inventors: Stefan Miltenyi, Gladbach; Gerard Buchholz, Berlin; Robert Herz, Overath, all of Germany

[73] Assignee: Miltenyi Biotec GmbH, Gladbach, Germany

[21] Appl. No.: 749,573

[22] Filed: Nov. 15, 1996

[51] Int. Cl.[6] ..... B01P 35/06

[52] U.S. Cl. ..... 210/222; 209/223.1; 435/173.1; 435/173.9; 436/526

[58] Field of Search ..... 210/222, 223, 210/695; 436/526; 435/173.1, 173.9; 209/223.1

[56] References Cited

U.S. PATENT DOCUMENTS 4,508,625 4/1985 Graham .
4,664,796 5/1987 Graham et al. .
4,666,595 5/1987 Graham .
4,769,130 9/1988 Christensen ..... 210/222
5,108,933 4/1992 Liberti et al. .
5,385,707 1/1995 Miltenyi et al. .
5,411,730 5/1995 Kirpotin et al. .
5,411,863 5/1995 Miltenyi .
5,466,574 11/1995 Liberti et al. ..... 210/222
5,512,332 4/1996 Liberti et al. .
5,541,072 7/1996 Wang et al. .
5,543,289 8/1996 Miltenyi .

*Primary Examiner*—David A. Reifsnyder
*Attorney, Agent, or Firm*—Morrison & Foerster, LLP

[57] ABSTRACT

A magnetic separator device is provided for separating biological materials from carrier fluids using the technique of high gradient magnetic separation. A release compensator reduces the amount of force that an operator needs to apply in order to remove a separation column from the magnetic field of the separator device. The release compensator may be a mechanical compensator, but is preferably a magnetic compensator. The magnetic separator device also preferably includes a mount for mounting the device to a wall. The mount is preferably a pair of additional magnets.

23 Claims, 6 Drawing Sheets

MAGNETIC SEPARATOR WITH MAGNETIC COMPENSATED RELEASE MECHANISM FOR SEPARATING BIOLOGICAL MATERIAL

TECHNICAL FIELD

The present invention relates to the application of high gradient magnetic separation (HGMS) to the separation of biological materials, including cells, organelles and other biological materials. Specifically, this invention relates to improvements in release mechanisms for facilitating the removal of a chamber containing magnetizable material, which may contain biological materials, from a magnetic source.

BACKGROUND ART

High gradient magnetic separation (HGMS) refers to a process for selectively retaining magnetic materials in a chamber or column disposed in a magnetic field. This technique can also be applied to non-magnetic targets labeled with magnetic particles. This technique is thoroughly discussed in U.S. Pat. Nos. 5,411,863 and 5,385,707, which are hereby incorporated by reference in their entireties.

The material of interest, being either magnetic or coupled to a magnetic particle, is suspended in a fluid and applied to the chamber. In the presence of a magnetic gradient supplied across the chamber, the material of interest, being magnetic, is retained in the chamber. Materials which are non-magnetic and do not have magnetic labels pass through the chamber. The retained materials can then be eluted by changing the strength of, or by eliminating the magnetic field.

U.S. Pat. No. 4,508,625 to Graham (Graham '625), discloses a process of contacting chelated paramagnetic ions with particles having a negative surface charge and contained in a carrier liquid to increase the magnetic susceptibility of the particles. A magnetic field is then applied to the carrier liquid and particles to separate at least a portion of the particles from the carrier liquid.

U.S. Pat. No. 4,666,595 to Graham (Graham '595), discloses an apparatus for dislodging intact biological cells from a fluid medium by HGMS. The fluid containing the cells is passed through a flow chamber containing a separation matrix having interstices through which the fluid passes. The matrix is subjected to a strong magnetic field during the time that the fluid passes therethrough. At least some of the cells are thereby magnetically retained by the matrix while the rest of the fluid passes therethrough.

Graham '595 further discloses a piezoelectric transducer in fluid communication with the matrix by means of the carrier fluid. When the matrix reaches its loading capacity for cells, the carrier fluid is replaced by an elutriation fluid. The piezoelectric transducer is then excited, to generate high frequency acoustic waves through the fluid in the chamber. The acoustic waves dislodge the cells (particles) from the matrix and are carried out by the elutriation fluid.

U.S. Pat. No. 4,664,796 to Graham et al. (Graham et al. '796) discloses an HGMS system for separating intact biological cells from a fluid medium. The system includes a flow chamber containing a separation matrix having interstices through which the fluid passes, and an associated magnetizing apparatus for coupling magnetic flux with the matrix. The magnetizing apparatus includes a permanent magnet having opposing North and South poles, and field guiding pole pieces. The flux coupler is positioned to pass a strong magnetic field through the matrix during the time that the carrier fluid passes therethrough to permit capture of the cells or particles by the matrix.

The flux coupler is positioned so that the magnetic flux is diverted away from the matrix during the elutriation phase, when the carrier fluid is replaced by an elutriation fluid, so that the viscous forces of the elutriation fluid exceed the weakened magnetic attractive forces between the matrix and the cells or particles, thereby permitting the elutriation fluid to carry away the cells or particles. Additionally, a piezoelectric transducer may be provided to be used in conjunction with the diversion of the magnetic flux by the flux coupler during the elutriation phase, to allow for a slower flow of elutriation fluid.

The matrix is positioned within the flow chamber so as to be subjected to the full magnetic flux of the magnet when the flow chamber is in a first position, during separation of the cells from the carrier fluid. When the flow chamber is rotated approximately 90° from the first position, during the elutriation phase, the matrix is positioned such that the magnetic flux substantially bypasses the matrix.

Graham et al. '795 further discloses the option of using a piezoelectric transducer in fluid communication with the matrix for use in conjunction with the positioning of the flux coupler to bypass the strong magnetic field around the matrix, to allow lower flow rates of the elutriation fluid.

The prior art addresses various methods of HGMS and methods of recapturing the cells/particles once they have been separated by HGMS. However, the art does not address problems associated with removing the separation chamber from a permanent magnetic field, which may be encountered. Also the art does not disclose a suitable way for removing columns through which a single process is performed. Further, the flux coupler of Graham et al. '795 lacks the ability to completely remove or turn off the magnetic field with respect to the column, and complete removal of the magnetic field is necessary for some applications, and for some column geometries. The present invention is directed to more efficient and effective use of the HGMS technique, which is especially useful in clinical and commercial settings.

DISCLOSURE OF THE INVENTION

The invention provides improvements in the high gradient magnetic separation apparatus. Application of the invention improvements to isolation of particular cells, proteins, polysaccharides and other biological materials or other particles that are magnetic or capable of a specific binding interaction to associate with a magnetic label, results in more efficient processes of isolating these materials.

In conducting a high gradient magnetic separation process, the external magnetic field used to magnetize the separation column needs to be switched on and off during the separation process. When using a permanent magnet to provide the magnetic field, the separation column must be physically removed from the magnetic field (or vice versa), in order to remove the collected cells (particles)from the matrix in the separation column. Depending upon the amount of particles to be collected, the construction of the separation column is altered, especially with regard to the amount of magnetizable particles and size of the matrix to be retained therein. Thus, as the column size gets bigger and relative degree of filling of the matrix with magnetizable particles increases, the magnetic retention force on the column also increases. The columns used in the present invention are designed to have very low carry-over, i.e., very few unlabelled cells or particles are retained within the column after processing. Consequently, some columns require a relatively high content of magnetic material, which results in a more powerful magnetic force being generated once the column is placed in the magnetic field.

A problem arises, especially with regard to attempts to remove such a column by hand from the magnetic field. The additional force required for removal has led to greater risks of breaking the column upon attempts to remove it, and/or spilling of the contents of the column due to jerking movements upon release of the column. These problems become even more critical when the operator is performing a sterile process, or when biohazardous materials are involved.

The present invention provides a magnetic separator for separating biological material, including a magnet having North and South poles defining a predetermined gap therebetween. The predetermined gap is dimensioned to receive a chamber therein so that the chamber is placed in a strong magnetic field. A release compensator is provided for moving into the predetermined gap to reduce a force necessary for removal of the chamber from the magnetic field defined in the predetermined gap.

The compensator may be a mechanical compensator that applies a mechanical force to remove the chamber, but preferably is a magnetic compensator that moves into the magnetic field of the magnet as the chamber moves out of the magnetic field.

Preferably, the magnetic compensator is only magnetically coupled to the magnet and/or magnet housing, such that it is removable from the magnet to be separately cleanable, among other things. Further, the compensator is removable from the magnet and/or magnetic housing to enable various different compensators to be substituted therefore. In this way, different compensators may be designed for use with the same magnetic separator, but to match different geometries, matrix capacities and relative fill of magnetizable material in different columns. Accordingly, a magnetic separator may be provided in kit form with a series of varying magnetic compensators designed to compensate for a series of different chamber having differing, but predetermined characteristics.

The chamber which is placed in the magnetic separator, containing a magnetic matrix /particles, and is adapted to receive fluid containing one or more biological materials for high gradient magnetic separation thereof.

A housing surrounds the magnet, and defines a channel into which the release compensator moves upon placement of the chamber in the predetermined gap. The magnetic separator may further include means for mounting it to the wall. Preferably, the means are for mounting to a magnetizable wall. More preferably, the means comprise at least one magnet in addition to the magnet which provides the magnetic field for HGMS. Still more preferably, the mounting means comprises a pair of additional magnets.

The housing of the magnetic separator may include a recess in an upper portion thereof, which also defines an upper boundary of a channel formed in the housing. The release compensator moves into the channel when a chamber is positioned in the predetermined gap between the North and South poles of the magnet. The recess may further comprise a stop portion against which the chamber abuts when it has been properly positioned in the predetermined gap.

Preferably, the release compensator comprises a compensator housing and a magnetizable member housed therein. The compensator housing is preferably dimensioned to abut an outer surface of the chamber and to maintain the magnetizable member in a position such that a distance between a longitudinal axis of the chamber and a longitudinal axis of the magnetizable member is substantially equal to the length of the magnet at the predetermined gap. The magnetizable member may be in a variety of shapes and forms, but preferably is a rod or cylinder.

BEST MODE FOR CARRYING OUT THE INVENTION

Figure 1:
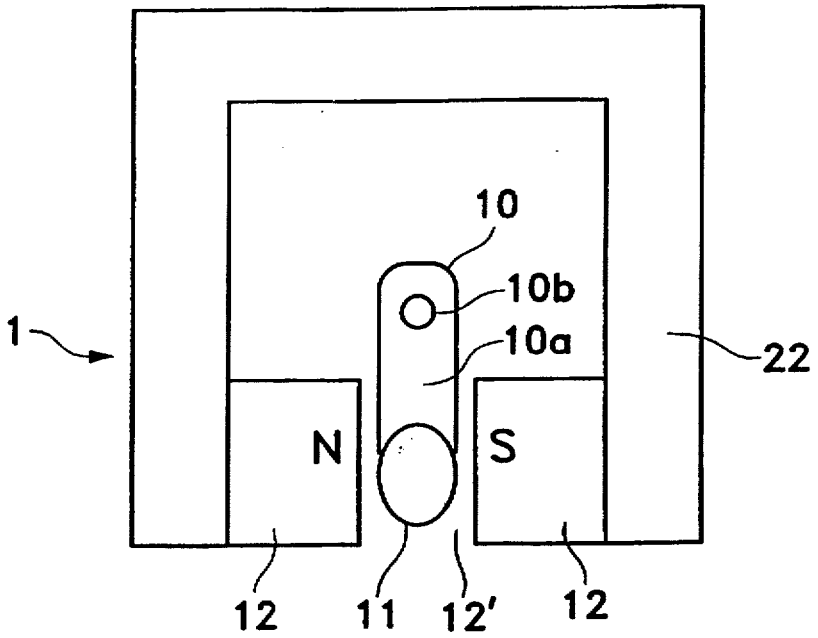
FIG. 1 is a top schematic view of the invention with a chamber containing a gradient-intensifying matrix disposed in the magnetic field.
Figure 2:
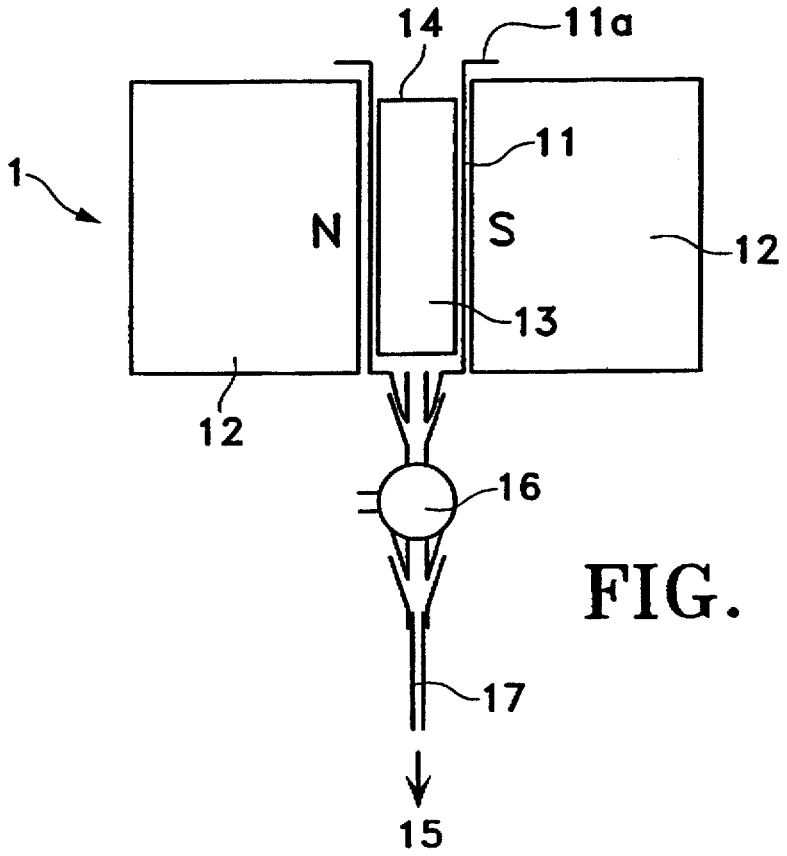
FIG. 2 is a front schematic view of the chamber and north and south poles of the magnet shown in FIG. 1.

A preferred embodiment of the present invention is schematically shown from a top view in FIG. 1. FIG. 2 shows the same embodiment from a front view. The device includes a magnet 12 having North and South poles which define a gap 12' therebetween. Magnet 12 is sufficiently strong to create a field of about 0.2–1.5 Tesla, preferably about 0.3–1.0 Tesla, most preferably about 0.6 Tesla. The magnet is preferably constructed of a commercially available alloy of neodinium/iron/boron, but other highly magnetized materials may also be used. A yoke 22 is preferably provided for increasing the magnetic flux in the gap and to support the overall mechanical construction to hold the magnets in direct opposition to one another to form gap 12'. The North and South poles may be provided by a conventional horseshoe type magnet or C shaped magnet or other known embodiments of magnets which provide North and South poles that form a predetermined gap therebetween.

As known, an electromagnet may also be substituted for permanent magnet 12 for performing HGMS, however, the scope of the present invention is directed to the preferred permanent magnet embodiments, in which the magnetic field cannot be "turned off" at the end of a collection of particles phase. Use of a permanent magnet allows the overall device to be made significantly smaller, lighter and less complicated, since no power source is required. However, for some applications (e.g. , superconducting magnets), the electromagnets may not be able to be turned off during processing, and therefore the present invention can also be usefully applied to electromagnets, as well.

When permanent magnet 12 is used, a separation column 11 is provided for collection of the biological materials or other materials of interest (hereafter, particles) from a carrier fluid which is poured through separation column 11. Separation column 11 contains a matrix 13 which includes magnetic material such as mesh, wires, spheres, coated spheres, or the like, that is permeable enough to allow the carrier fluid to flow therethrough. Separation column 11 is placed directly in the magnetic field of magnet 12 (i.e., in gap 12') for collecting the particles from the carrier fluid. The carrier fluid is then poured through separation column at a controlled, predetermined rate which varies with the type of particles to be collected. The column itself may be designed to maintain a certain flow rate e.g., a column with a 6 mm diameter by 40 mm height matrix may be filled with iron spheres coated with an impermeable coating and constructed to have a flow rate of about 0.5 to 4.0 ml/min, or preferably about 1.0 to 2.0 ml/min.

As the carrier fluid passes though separation column 11, the particles, being either magnetic themselves, or bound to a magnetic label, are attracted to and held by magnetic matrix 13, the magnetic forces between matrix 13 and the particles being greater than the gravitational forces and viscous forces of the carrier fluid which are applied to the particles. At the end of the collection phase, flow of the carrier fluid is terminated and a wash phase is conducted to rinse out the non-magnetic cells/particles. The wash fluid flow through separation column 11 is then terminated, and the magnetic field must also be substantially eliminated to allow retrieval of the particles from matrix 13. In the case of an electromagnet, generally the electromagnet is simply de-energized or "turned off" at this time. However, in the case of permanent magnet 12, separation column 11 must be forcibly removed from gap 12', or device 1 must be forcibly withdrawn from surrounding separation column 11.

Magnetic separation columns which require a relatively high content of magnetic material, e.g., where the iron or other magnetic material content of the separation chamber is about 30–80%, preferably about 50–70% of the total volume occupied in the separation column, also require a substantial amount of force for removal from the magnetic field. The amount of force required rises to a level that introduces inefficiencies in HGMS processing. These inefficiencies are caused by breakage of the separation columns upon attempts at removal from the magnetic field, spillage of the contents of the separation columns upon attempts at removal of the column from the magnetic field, greater time required even for a successful removal, and frustration in those performing the removal step, among others. Attempts at removing the HGMS device from the separation column have been fraught with similar inefficiencies.

Figure 5:
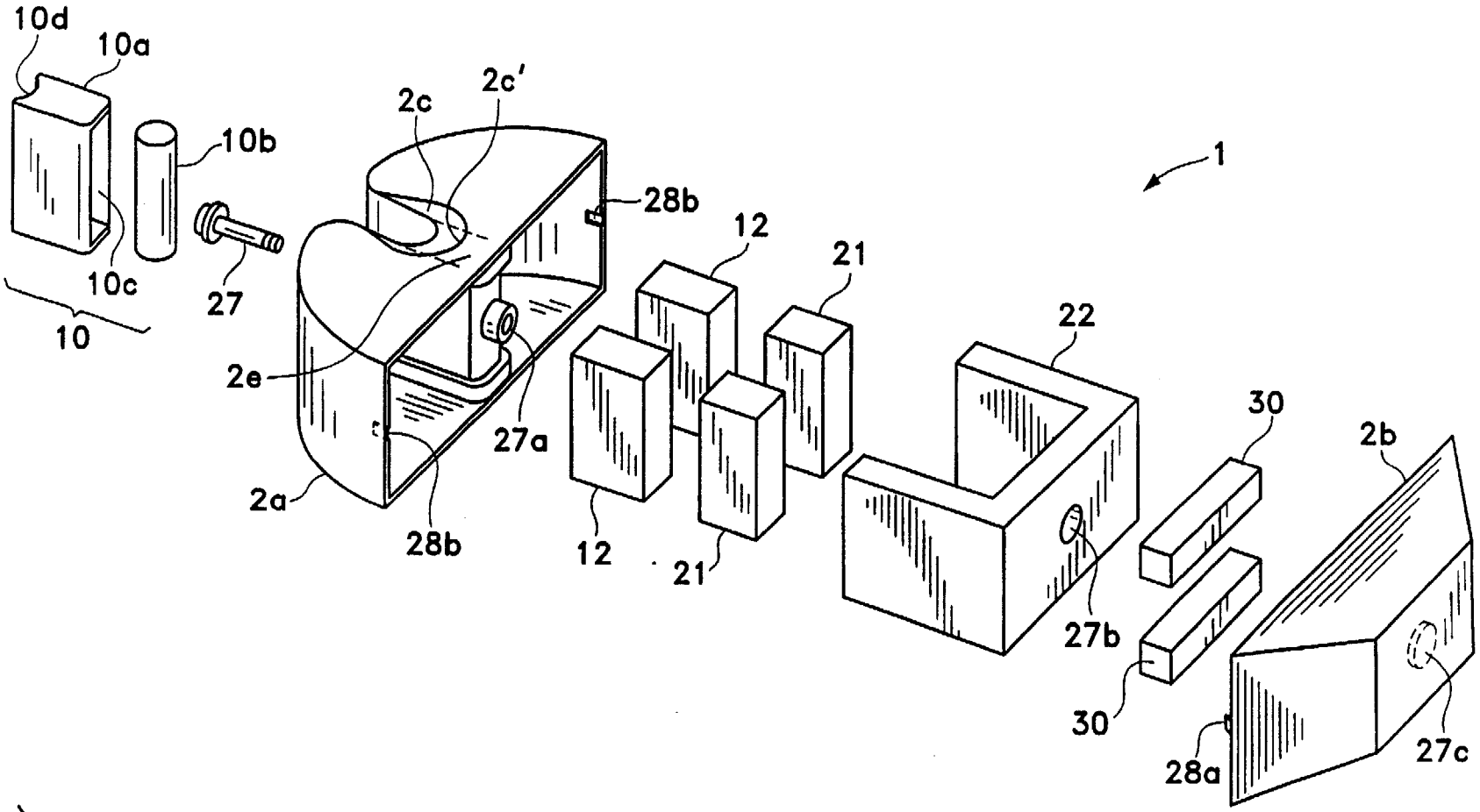
FIG. 5 is an exploded view of the magnetic apparatus and compensator according to a preferred embodiment of the present invention.

The present invention eliminates the above-described inefficiencies by providing a compensator, or release mechanism, which significantly reduces the force which must be applied by an operator in order to remove a separation column from a magnetic field. In a preferred embodiment, magnetic compensator 10 is provided. As shown in FIG. 5, magnetic compensator 10 comprises a compensator housing **10*a* and a magnetizable member 10*b*. Magnetizable member 10*b* is preferably an iron rod or cylinder sized and shaped to have a magnetic susceptibility substantially equal to that of the matrix in the separation column for which it is designed. However, magnetizable member may alternatively be made from other magnetizable materials, either in the shape of a rod or cylinder, or other shape which will provide a magnetic susceptibility substantially similar to the matrix for which it is designed. "Magnetic susceptibility" is used here to mean the amount of magnetic force by which the compensator is attracted to magnet 12, as well as the shape of the distortions in the magnetic field of magnet 12**, which are caused by such attraction.

Compensator housing **10*a*** is preferably a thin-walled plastic structure having a width substantially equal to the outside diameter of the separation column which it is designed to compensate for. Alternatively, the compensator housing may be formed of glass, rubber, silicone, plastics, or any other acceptable material which is both readily cleanable or sterilizable and non-magnetic.

Figure 6:
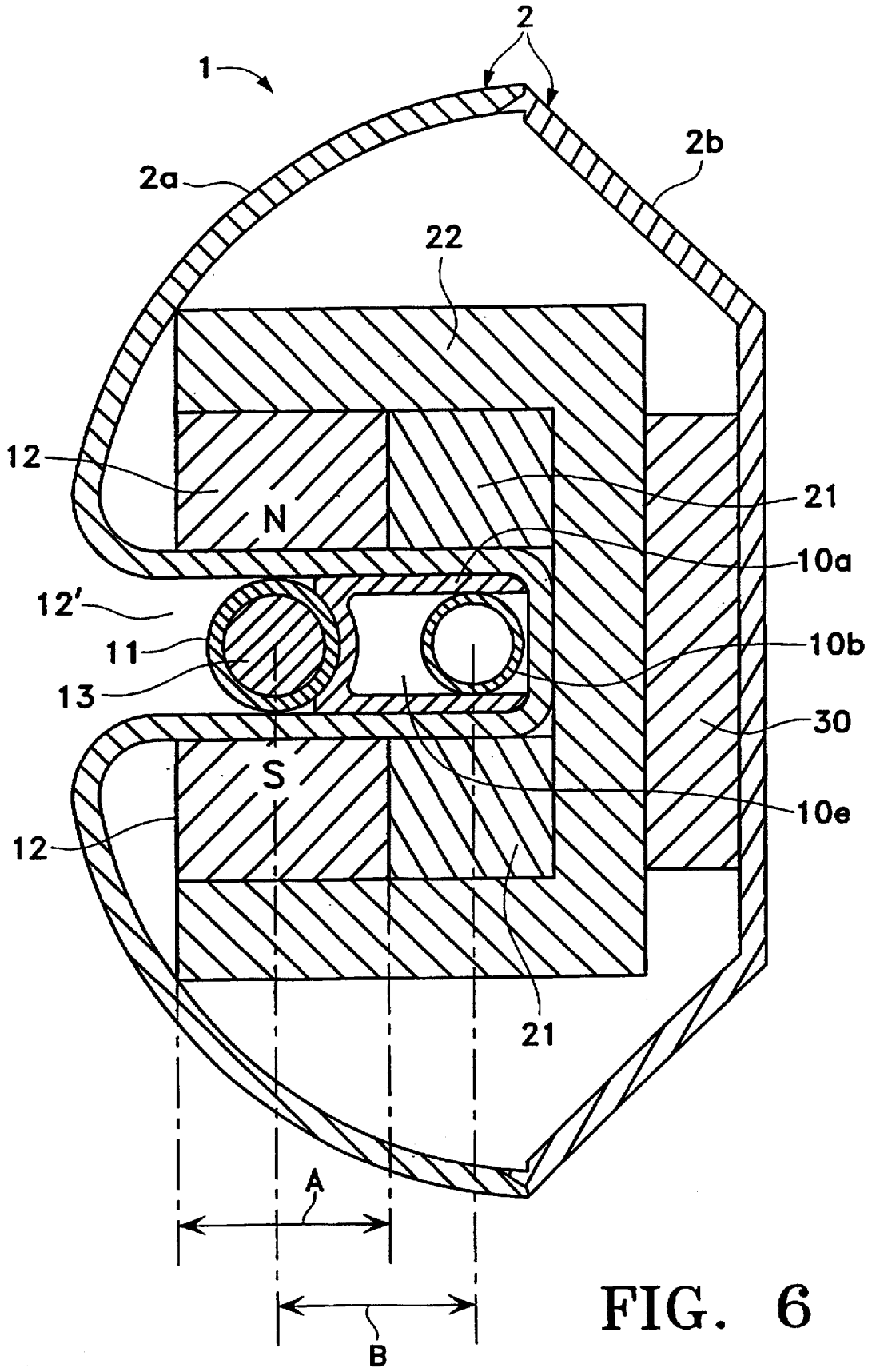
FIG. 6 is a cross-sectional view of the apparatus with a chamber containing a gradient-intensifying matrix disposed in the magnetic field.

FIG. 6 shows a cross-section of the embodiment of FIG. 5, with separation column 11 positioned in gap 12' ready for a collection phase to be carried out. As shown, the HGMS device preferably includes a housing 2 which encloses the magnetic apparatus, including magnet 12 and yoke 22. Housing 2 is preferably formed in two portions from thin walled plastic, i.e., front housing **2*a* and rear housing 2*b***. However, the housing may be formed in other shapes and from other acceptable materials known to those skilled in the art, which are readily cleanable or sterilizable and non-magnetizable, e.g., fiberglass, fiber reinforced plastics, etc.

The North and South poles of magnet 12 are maintained at a constant distance from one another by mounting to yoke 22. Yoke 22 is preferably made of iron, but other equivalent materials known to those of ordinary skill in the art may also be substituted. Magnet 12 is also mounted to spacers 21, to maintain the North and South poles in alignment across gap 12'. With regard to gap 12', it is noted that, in the preferred embodiment, gap 12' is defined by the walls of front housing **2*a* in combination with magnet 12, as the thin walls of the housing contact with and overlay magnet 12. Thus, although magnet 12 is primarily responsible for establishing gap 12', it does so in conjunction with the thin walls of front housing 2*a* in the preferred embodiment. Spacers 21 are made of a non-magnetizable material, preferably plastic, but other equivalent materials known to those of ordinary skill in the art may also be substituted. The mounting of magnets 12 to yoke 22 and spacers 21 is preferably performed by commercially available silicone sealants, but other known equivalent mounting means may be used, such as other adhesives, brackets and screws or bolts, clamps, or housing 2 can be molded with restraining walls to hold the magnet 12, spacers 21 and yolk 22** in their corresponding positions, for example.

The HGMS device 1 is preferably provided with mounting means 30 for mounting the device to a wall. Preferably, the mounting means includes at least one additional magnet 30, mounted to the inside of back housing **2*b* between yoke 22 and back housing 2*b*, see FIG. 6. More preferably, the mounting means comprises two additional magnets 30 as shown in FIG. 5. The additional magnets are strong enough to mount device 1 to a magnetic wall surface and maintain the device 1 in the mounted position even during removal of separation column 11 from gap 12'. Other known mounting means may be used to mount device 1** to a wall surface during processing, e.g., one or more screws, hook and loop type fastening means, brackets, etc., however, two additional magnets are the preferred means.

FIG. 5 shows an exploded view of device 1 and a preferred means of joining the housing portions **2*a*, 2*b*. Preferably, front housing 2*a* is connected to rear housing 2*b* by screw 27. Screw 27 passes through alignment guide 27*a* and hole 27*b* provided in yoke 22, between magnets 30 and is threaded into receiving portion 27*c*. Also, protuberances 28*a* and receiving holes 28*b* may be provided in back housing 2*b* and front housing 2*a***, respectively, or vice versa.

for ensuring proper alignment of the housing portions while they are being screwed together and thereafter. Preferably, the front and rear housings 2a, 2b are also glued together (e.g., by silicone sealant or other known, equivalent adhesive) to seal out water, disinfectants, etc, to which the housing will be exposed during processing. Of course, otherjoining means may be used instead of or in conjunction with the previously described screw and protuberance combination. Other means include various adhesives, nuts and bolts, heat welding, ultrasonic welding, etc.

Compensator housing 10a has a height which is slightly less than the height of magnet 12. Magnetizable member 10b has a height which is slightly less than the height of compensator housing 10a, so that magnetizable member 10b can be accommodated within compensator housing 10a through compensator opening 10c. Compensator housing 10a further has a substantially concave front surface 10d which is formed to accommodate the outer surface of separation column 11 when the two pieces contact each other. In this regard, the front surface of the compensator housing is not intended to be limited to a substantially concave surface, but may be formed as a substantially inverse contour of the outer contour of the separation column which the compensator housing is designed to function with. For example, if the separation column to be used is diamond-shaped in cross-section, the front surface of the compensator housing would be substantially v-shaped.

As mentioned earlier, the compensator is also removable from the magnetic separator, to allow varying compensators to be inserted therefor, to compensate for various columns having different magnetic retention characteristics within the same magnetic separator. That is, each compensator is specifically constructed to compensate for a specific column having a predetermined content and configuration of magnetic material. The shape and especially the mass of the iron or other magnetizable material forming the magnetizable member 10b is varied to accommodate varying volumes and shapes of matrices in columns. The shape of the member 10b may be modified to optimize the compensation characteristics.

FIG. 6 demonstrates that the length of compensator housing 10a is such that magnetizable member 10b is optimally spaced from matrix 13 in separation column 11. Magnetizable member 10b is optimally spaced from matrix 13 when the distance from the longitudinal axis of matrix 13 to the longitudinal axis of magnetizable member 10b (distance "B" in FIG. 6) is equal to the length of magnet 12, which is also by definition, the length of gap 12' (distance "A" in FIG. 6 ). With this placement, the magnetizable member approaches the magnetic field in gap 12' equidistantly with the departure of separation column 11 (and matrix 13) from the magnetic field in gap 12'. This causes the magnetic field strength to be divided among the matrix 13 and magnetizable member 10b, thereby greatly reducing the retention force of the magnetic field on the matrix, as the operator attempts to remove the separation column. As a result, the separation column can be removed much more easily, thereby greatly reducing the risk of breakage of the column or spillage of the column's contents. Thus, magnetizable member 10b magnetically compensates for the attractive forces between magnet 12 and matrix 13 by having a substantially similar magnetic susceptibility at a distance from the magnetic field which is substantially equal to the distance of matrix 13 from the magnetic field. Of course, this is the optimum and preferred arrangement of the magnetizable member. The concept of compensation is still valid if the magnetizable member is placed at a different distance from the matrix than previously described. However, the amount of compensation achieved would not be as effective.

Figure 3:
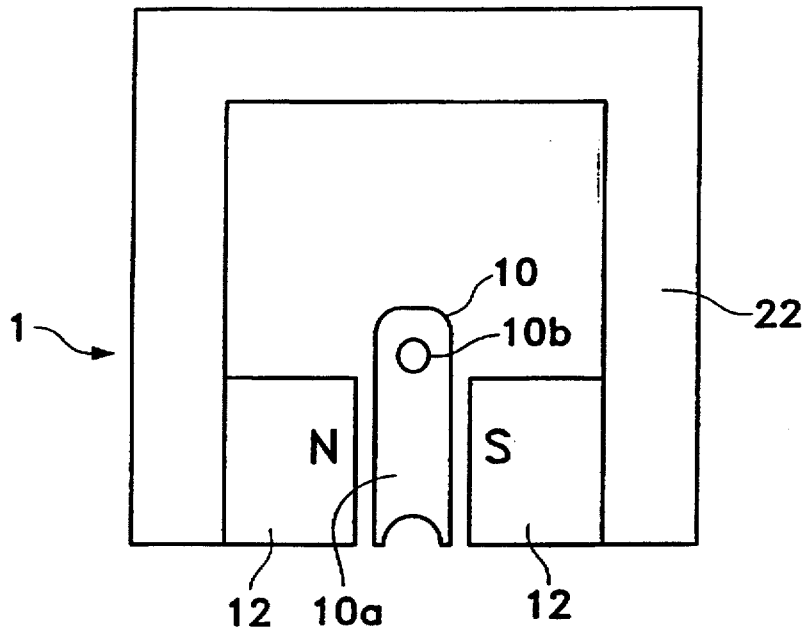
FIG. 3 is a top schematic view of the invention with the chamber removed, thereby rendering the release mechanism or compensator visible.
Figure 4:
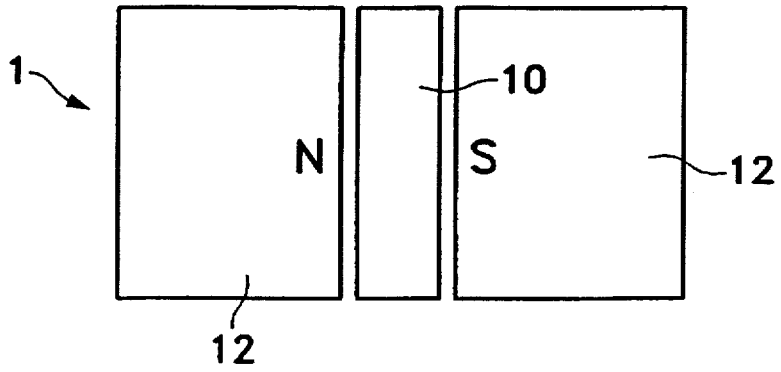
FIG. 4 is a front schematic view of the release mechanism (compensator) and north and south poles of the magnet shown in FIG. 3.
Figure 7:
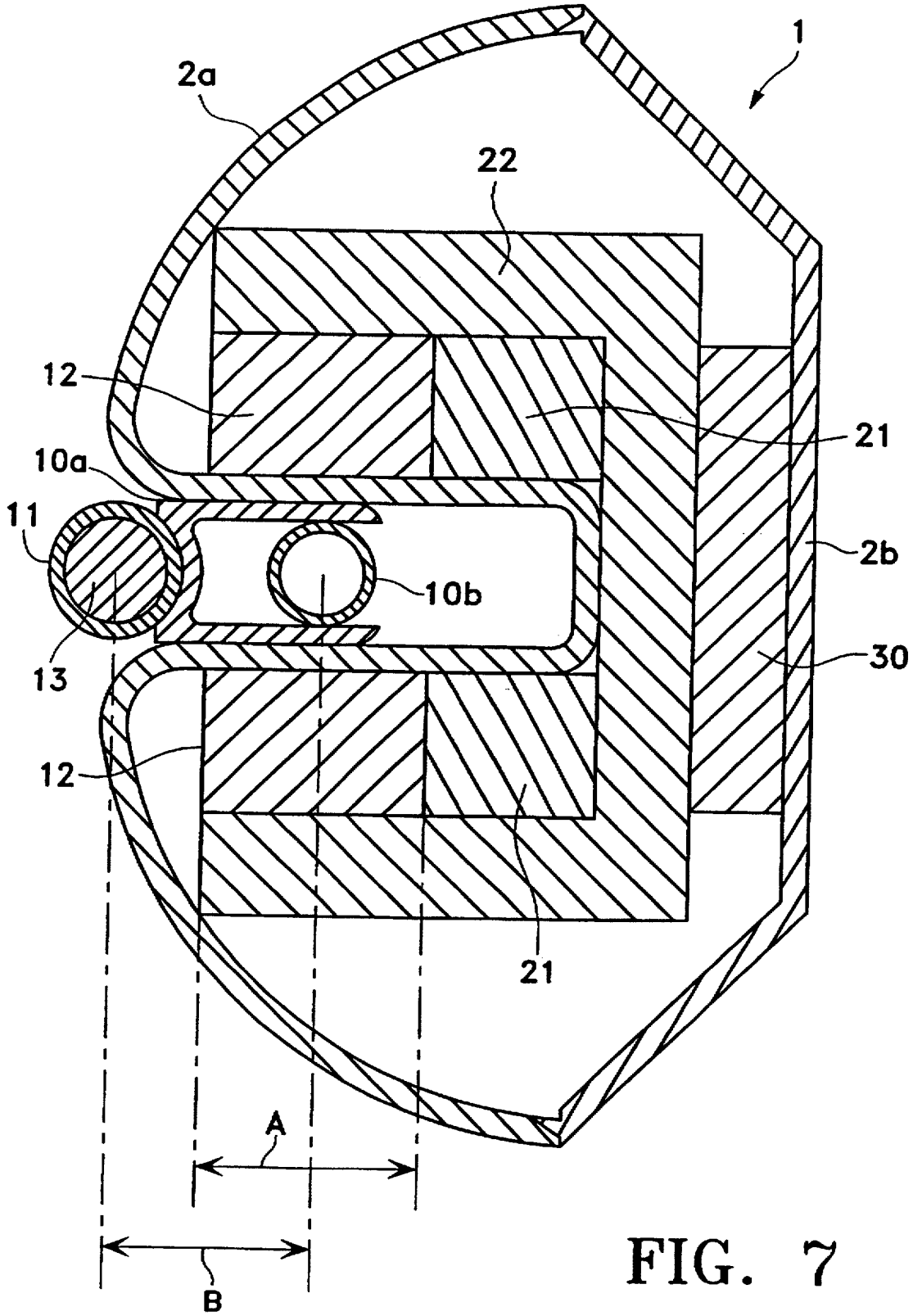
FIG. 7 is a cross-sectional view of the apparatus with a compensator disposed in the magnetic field.

The remainder of the space 10e inside compensator housing 10a is filled with a non-magnetizable filler such as glue, or silicone gel or the like, for the purpose of maintaining magnetizable member 10b in proper position. Upon complete compensation (i.e., removal) of separation column 11, compensator 10, and specifically magnetizable member 10b is aligned in the magnetic field formed in gap 12', where separation column 11 had been positioned during the collection phase, as shown in FIGS. 3, 4 and 7.

Front housing 2a includes a recessed portion 2c which receives and supports a lip portion 11a of separation column 11, see FIGS. 2 and 5. When separation column 11 is properly aligned in the magnetic field in gap 12', the outer contour of column 11 abuts against the rear boundary 2c' of recessed portion 2c, thus confirming to the operator that separation column 11 is optimally placed. Recessed portion 2c further serves as an upper boundary of channel 2e ( shown in phantom in FIG. 5) formed in front housing 2a, into which compensator 10 travels when separation column 11 is placed in gap 12'. Channel 2e has substantially the same width and height as gap 12', and ensures that compensator 10 is maintained in alignment with gap 12' and separation column 11, so that separation column 11 may be successfully compensated at the time of removal thereof.

Figure 8:
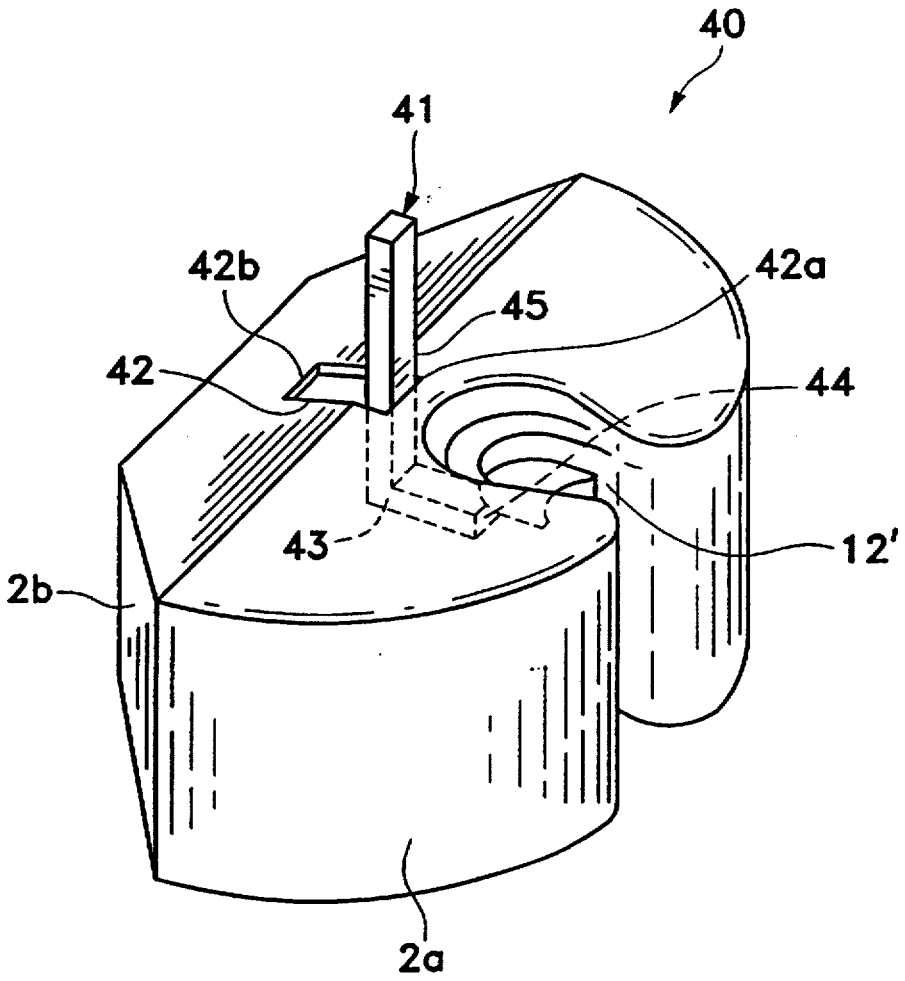
FIG. 8 shows a mechanical embodiment of the release mechanism or compensator.

FIG. 8 shows a second embodiment of a device 40 according to the present invention, in which a mechanical compensator 41 is used. Slot 42 is formed in the top portion of housing 2 and preferably extends from front housing 2a to rear housing 2b as shown in FIG. 8. Lever 45 extends through slot 42 and is pivotally mounted to the interior of front housing 2a via pivot 43. The lower end of lever 45 bends towards gap 12' and is connected to pushing surface 44. Pushing surface 44 is preferably contoured in a substantially concave shape, or whatever shape complements the exterior surface of the separation column which the mechanical compensator is designed to compensate for.

When separation column 11 is placed into the magnetic field in gap 12', pushing surface 44 is pushed back into channel 2e and the upper portion of lever 45 abuts the front end 42a of slot 42. After the collection phase has run its course, or when the operator wants to remove the separation column for any reason, the operator simply applies pressure to the upper portion of lever 45, thereby forcing it back into abutment with the rear end 42b of slot 42. This action causes movement of pushing surface 44 against the outer surface of separation column 11 and into gap 12', thereby extricating separation column 11 from gap 12'. Because of the mechanical advantage of the lever, the operator is able to apply a smaller, more consistent force to the separation column in order to remove it with less risk of breakage or spillage. However, because the force applied by pushing surface 44 varies substantially linearly with the force applied by the user, the user must still vary the applied force during extrication, because the magnetic attraction of the magnetic field with the matrix does not reduce linearly with distance. In contrast, when using the magnetic compensator, the compensation forces between the compensator 10 and the magnetic field are substantially equal to the attraction forces between the magnetic field and the separation column, and therefore the operator can apply a substantially consistent force to remove the separation column.

Other types of mechanical compensators may also be employed with the HGMS device. For example, a spring loaded pushing member may be employed, wherein the member may be cocked upon placement of the separation column in the magnetic field. To remove the separation column, a button or trigger may be provided to release the potential energy stored in the spring, causing the pushing member to push the separation column out of the magnetic field thereby releasing it. As with the embodiment shown in FIG. 8, the force applied by the spring loaded pushing member can usually be expected to be substantially linear, since spring constants are generally designed to be substantially linear. Since the attractive forces of the magnetic field are nonlinear with distance, it is difficult to match the spring constant with the force needed, since the force needed varies as the distance of the separation column from the magnetic field varies.

Still other mechanical compensation devices may be used with the HGMS mechanism. A cam may be provided between a lever and pushing mechanism to attempt to better match the nonlinearity of the magnetic field. For large scale operations, where the separation columns used are in the neighborhood of ten or more times greater than those discussed above (those discussed above being hand releasable), the permanent magnet device may be provided on wheels. A motor is provided to drive a mechanism to move the magnet device away from the separation column.

The invention can be embodied in other specific forms without departing from the sprit or essential characteristics thereof. The present embodiments therefor are to be considered in all respects as illustrative and not restrictive, the scope of the invention being indicated by the appended claims rather than by the foregoing description, and all changes which come within the meaning and range of equivalency of the claims therefore are intended to be embraced therein. CLAIMS

We claim:

1. A magnetic separator for separating biological material which is either magnetic or bound to a magnetic material, comprising:

a magnet having North and South poles defining a predetermined gap therebetween, said predetermined gap dimensioned to receive a chamber therein; and a release compensator separate of the chamber and being movable into said predetermined gap to reduce a force necessary for removal of the chamber from said predetermined gap, wherein said release compensator remains in said predetermined gap even when the chamber is completely removed from the magnetic separator so as to no longer contact said release compensator.

2. The magnetic separator of claim 1, wherein said release compensator comprises a mechanical compensator that applies a mechanical force between said magnet and the chamber.

3. The magnetic separator of claim 1, wherein said release compensator comprises a magnetic compensator that moves into the magnetic field of said magnet and is magnetically coupled to said magnet as the chamber moves-out of said magnetic field.

4. The magnetic separator of claim 3, wherein said magnetic compensator is only magnetically coupled to said magnet and is removable from said magnet.

5. The magnetic separator of claim 3, wherein said magnetic compensator is removable from said magnet for replacement by a second compensator having different compensation characteristics than said magnetic compensator.

6. The magnetic separator of claim 4, wherein said magnetic compensator comprises a sterilizable material and said magnetic compensator is separately sterilizable from said magnet and from the chamber.

7. The magnetic separator of claim 1, wherein said magnetic separator is formed of sterilizable material.

8. The magnetic separator of claim 3, said chamber containing magnetic particles and adapted to receive fluid containing the biological material for high gradient magnetic separation thereof, wherein the biological material is either magnetic or bound to a magnetic material.

9. The magnetic separator of claim 1, further comprising:

a housing surrounding said magnet, said housing comprising a channel into which said release compensator moves upon placement of a chamber in said predetermined gap.

10. The magnetic separator of claim 1, further comprising:

means for mounting said magnetic separator to a wall.

11. The magnetic separator of claim 10, wherein said means for mounting comprises means for mounting said magnetic separator to a magnetic wall.

12. The magnetic separator of claim 10, wherein said means for mounting comprises at least one magnet.

13. The magnetic separator of claim 12, wherein said at least one magnet comprises a pair of magnets.

14. A magnetic separator for separating biological material which is either magnetic or bound to a magnetic material, comprising:

a magnet having North and South poles surrounded by a housing defining a predetermined gap therebetween, said predetermined gap dimensioned to substantially match a width of a chamber to be received therein; and a release compensator separate of the chamber and being movable into said predetermined gap to reduce a force necessary for removal of the chamber from said predetermined gap, wherein said release compensator remains in said predetermined gap even when the chamber is completely removed from the magnetic separator so as to no longer contact said release compensator.

15. The magnetic separator of claim 1, wherein said housing further comprises a recess in an upper portion thereof, said recess defining an upper boundary of a channel formed in said housing, wherein said release compensator moves into said channel when a chamber is positioned in said predetermined gap.

16. The magnetic separator of claim 15, said recess further comprising a stop portion against which a chamber abuts when properly positioned in said predetermined gap.

17. A magnetic separator for separating biological material which is either magnetic or bound to a magnetic material, comprising:

a magnet having North and South poles defining a predetermined gap therebetween;

a chamber positionable within said predetermined gap, said chamber containing a magnetic matrix; and a release compensator separate of said chamber and being movable into said predetermined gap to reduce a force necessary for removal of said chamber from said predetermined gap, wherein said release compensator remains in said predetermined gap even when said chamber is completely removed from the magnetic separator so as to no longer contact said release compensator.

18. The magnetic separator of claim 17, wherein said magnet has a length defining said predetermined gap between said North and South poles;

said release compensator comprising a compensator housing and a magnetizable member housed therein;

said compensator housing dimensioned to abut an outer surface of said chamber and to maintain said magnetizable member in a position such that a distance between a longitudinal axis of said chamber and a longitudinal axis of said magnetizable member is substantially equal to said length of said magnet.

19. The magnetic separator of claim 18, wherein said magnetizable member comprises a rod.

20. The magnetic separator of claim 18, wherein said magnetizable member comprises a cylinder.

21. A kit for performing high gradient magnetic separation, comprising:

a magnet having North and South poles defining a predetermined gap therebetween, said predetermined gap dimensioned to receive a chamber therein; and a first release compensator being movable into said predetermined gap to reduce a force necessary for removal of a first chamber from said predetermined gap; and a second release compensator being movable into said predetermined gap to reduce a force necessary for removal of a second chamber from said predetermined gap, wherein said reduction force by said first release compensator is unequal to said reduction of force by said second compensator.

22. A magnetic separator for separating biological material which is either magnetic or bound to a magnetic material, comprising:

a magnet having North and South poles defining a predetermined gap therebetween, said predetermined gap dimensioned to receive a chamber therein;

a housing surrounding said magnet and having a back surface;

a recess defined by said housing between said predetermined gap and said back surface; and a release compensator alternately positionable into said predetermined gap and into said recess.

23. A magnetic separator for separating biological material which is either magnetic or bound to a magnetic material, comprising:

a magnet having North and South poles defining a predetermined gap therebetween, said predetermined gap dimensioned to receive a chamber therein; and a release compensator being movable into said predetermined gap to reduce a force necessary for removal of the chamber from said predetermined gap, wherein said release compensator comprises a mechanical compensator that applies a mechanical force between said magnet and the chamber.

* * * * *